United States Patent [19]

Bidoia et al.

[11] Patent Number: 4,893,384

[45] Date of Patent: Jan. 16, 1990

[54] SHOE BUCKLE

[75] Inventors: Vancenzo Bidoia, Castelfranco V; Orelio Mogno, Paese, both of Italy

[73] Assignee: Lange International S.A., Switzerland

[21] Appl. No.: 311,464

[22] Filed: Feb. 15, 1989

[30] Foreign Application Priority Data

Mar. 31, 1988 [CH] Switzerland ..... 12358/85

[51] Int. Cl.[4] ..... A43C 11/00

[52] U.S. Cl. ..... 24/68 SK; 24/70 SK; 24/71 SK

[58] Field of Search ..... 24/68 SK, 69 SK, 70 SK, 24/71 SK; 36/50

[56] References Cited

U.S. PATENT DOCUMENTS

| | | | |
|---|---|---|---|
| 3,173,182 | 3/1965 | Teufel | 24/68 SK |
| 4,470,175 | 9/1984 | Chiarella | 24/68 SK |
| 4,553,292 | 11/1985 | Pradier et al. | 24/68 SK |
| 4,654,985 | 4/1987 | Chalmers | 24/68 SK X |

*Primary Examiner*—James R. Brittain

*Attorney, Agent, or Firm*—Kane, Dalsimer, Sullivan, Kurucz, Levy, Eisele and Richard

[57] ABSTRACT

The buckle comprises a tensioning lever (2) on which there is hinged an attachment element (14) to which there is fixed a pulling rod (13) having a threaded part passing through the attachment element (14) and retained on the latter by a button (22) screwed onto the end of the pulling rod (13). By rotating the button it is possible to adjust the active length of the pulling rod. The pin (30) for hinging the attachment element (14) serves at the same time as a means for locking the rod (13).

4 Claims, 1 Drawing Sheet

SHOE BUCKLE

FIELD OF THE INVENTION

The present invention relates to a shoe buckle comprising a base intended to be fixed onto a shoe part, a tensioning lever with two arms hinged on this base by the end of its arms, a first hooking member intended to be hooked onto a second hooking member fixed to another part of the shoe, connecting means, with an adjustable length, between the first hooking member and the tensioning lever comprising a support for the first hooking member provided with a rod having a threaded part by means of which it is integral with a tensioning lever attachment element.

PRIOR ART

A buckle of this type is described, for example, in U.S. Pat. No. 4,051,611. In this buckle, the first hooking means, consisting of a ring, is integral with a support provided with a threaded hole into which is screwed a threaded rod integral with the lever attachment element. In order to perform fine adjustment of the buckle, the ring support is screwed or unscrewed. Since the ring is driven in rotation, this adjustment can only be performed when the buckle is in an unfastened position. Furthermore, the ring, which is free to rotate about itself, may sometimes assume a position unsuitable for hooking it onto the hooks integral with the other part of the shoe.

The object of the invention is to provide a buckle of the type described further above, in which fine adjustment of the length of the buckle may be effected without unfastening the buckle. It has also been attempted to make a buckle which is as flat as possible and with as simple a design as possible.

SUMMARY OF THE INVENTION

In the shoe buckle according to the invention, the attachment element consists of a retaining piece hinged on the tensioning lever by a pin and having a cylindrical longitudinal hole which passes through it from end to end and through which the said rod passes, and of a rotating adjustment button provided with a tapped hole into which the said threaded part of the rod is screwed, this button bearing against the end of the attachment element opposite to the first hooking means, and the assembly formed by the threaded rod and the adjustment button is axially locked inside the attachment element by the said pin.

According to a preferred embodiment, the threaded part of the rod has a milled portion over a part of its length, a milled portion inside which a part of the circumference of the said pin is engaged, so as to limit the travel of the rod inside the attachment element. Cooperation between the pin and the milled portion prevents, moreover, the threaded rod, and consequently the first hooking member, from rotating. Owing to play between the pin and the milled portion, it is possible, however, to perform a slight rotational movement so as to ensure that the two hooking members are mutually aligned. The rotating button is preferably provided with a groove by means of which it is retained axially inside the attachment element via a pin.

The adjustment button may be rotated without unfastening the buckle. Moreover, the hinging pin of the attachment element also acts as a retaining pin.

BRIEF DESCRIPTION OF THE DRAWINGS

The accompanying drawing shows, by way of example, two embodiments of the invention.

DESCRIPTION OF THE PREFERRED EMBODIMENT(S)

Figure 1:
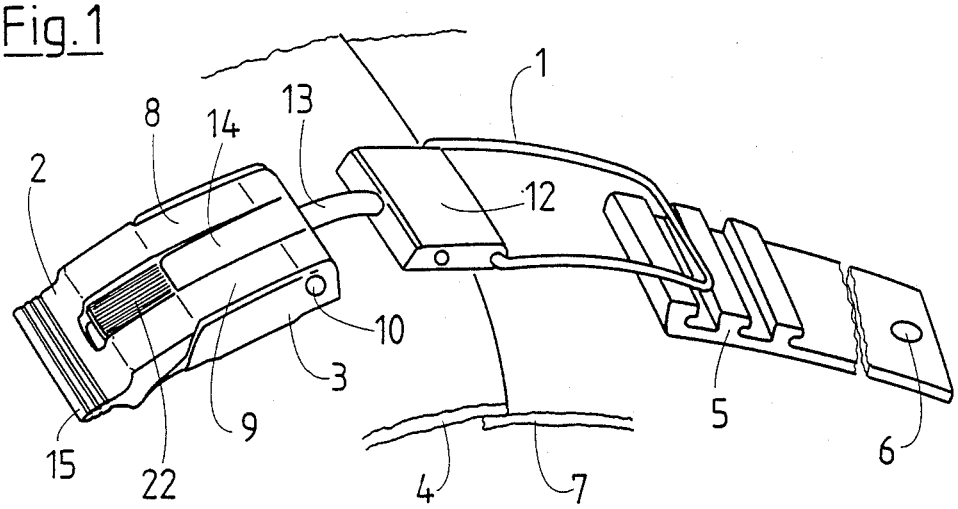
FIG. 1 is a perspective view of a first embodiment of the buckle in the closed position.
Figure 2:
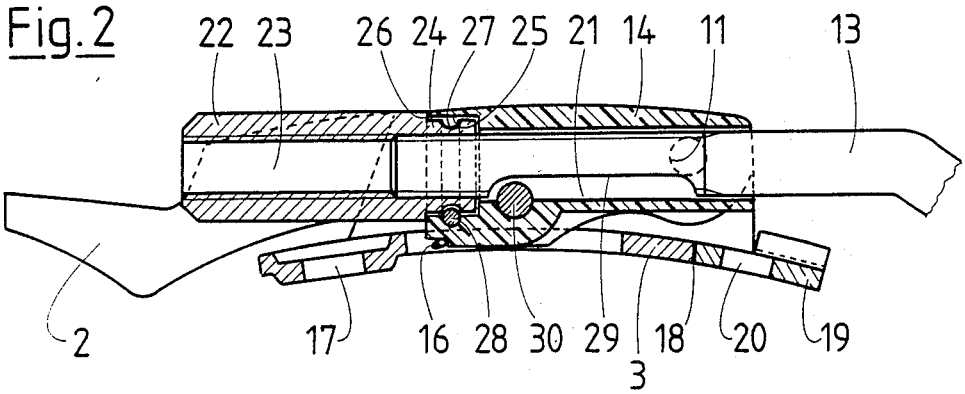
FIG. 2 is a partial view, sectioned along the line II—II of FIG. 1.

The buckle shown in FIGS. 1 and 2 comprises a ring 1 joined to a tensioning lever 2 hinged on a base in the form of a stirrup 3 fixed onto a part 4 of a shoe, the center piece hooking into one of the notches of a hooking rack 5 fixed by means of a rivet 6 on another part 7 of the shoe. The tensioning lever 2 has two arms 8 and 9 at the end of which it is hinged by means of two pins 10 and 11 (FIG. 2) on the two flanges of the base 3. The ring 1 is fixed onto a support 12 and is joined via a bent rod 13 to an attachment element 14 itself hinged between the arms 8 and 9 of the tensioning lever 2, at a point located between the pins 10 and 11 and the end 15 of the tensioning lever. With respect to the elements described above, the buckle shown is similar to the buckle described in U.S. Pat. No. 4,051,611. It also comprises a spring catch, one bent end of which 16 can be seen in FIG. 2, tending to keep the tensioning lever 2 in the closed position.

The base 3 has, on the one hand, a hole 17 so that it can be fixed by means of a rivet to the shoe (FIG. 2) and, on the other hand, at its other end, two teeth 18 for hooking it onto a plate 19 itself fixed to the shoe by a rivet through a hole 20.

The attachment element 14 has the shape of a compass provided with an axial circular hole 21. This hole has passing through it the rod 13 provided with a thread by means of which it is screwed inside the tapped hole 23 of a cylindrical cap 22. This button 22 has a cylindrical constriction 24 engaging inside a widened portion 25 of the hole 21. The shoulder 26 thus formed on the button 22 bears against the end of the attachment element 14. The constriction 24 of the button 22 has a circular groove 27 inside which there engages a pin 28 driven inside attachment element 14, this pin 28 axially retaining the button 22 on the attachment element 14, while allowing it to rotate on and inside this attachment element.

The threaded part of the rod 13 has, over part of its length, a milled portion 29 parallel to the axis of the rod; this milled portion 29 has passing transversely through it half the cross section of a pin 30 which is the pin for hinging the attachment element 14 with the arms 8 and 9 of the tensioning lever 2. The rod 13 is thus locked inside the attachment element 14 with the possibility of moving axially inside this attachment element by an amount equal to the length of the milled portion 29.

As can be seen from the drawing, the attachment element 14 is preferably made of synthetic material.

It can be seen immediately that rotating the button 22 produces a variation in the distance between the ring 1 and its hinging axes 30 on the tensioning lever, and consequently in the tightness of the buckle.

The ring 1 could of course be replaced by any other hooking member, for example a part with a curved hook-shaped end or a part provided with notches similar to the part 5 cooperating with a suitable element on the other part of the shoe.

Figure 3:
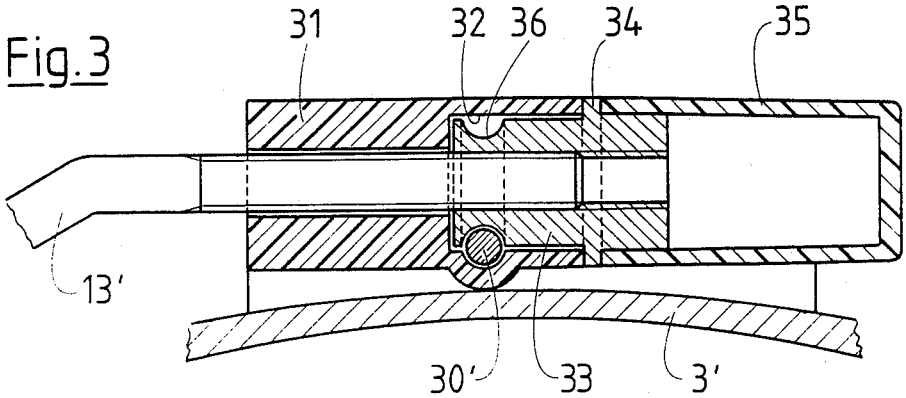
FIG. 3 is a partial view, in longitudinal section, of a second embodiment.

The second embodiment shown in FIG. 3 has several elements which are common to the first embodiment. These common elements either have not been shown or are indicated by the same reference as in FIGS. 1 and 2 with a'.

This embodiment comprises an attachment element 31 hinged between the cheeks of the base 3' by means of a pin 30'. The attachment element 31 has a cylindrical recess 32 inside which there is engaged a cylindrical nut 33 into which the threaded rod 13' is screwed. This nut 33 is provided with a flange 34 which bears against the end of the attachment element 31. A channeled cap 35 made of synthetic material is fixed onto the nut 33 and forms the adjustment button. The nut 33 is provided, moreover, with an annular groove 36 inside which a part of the pin 30' is engaged. In this case, it is therefore the adjustment button which is locked by the pin 30'.

We claim:

1. A shoe buckle comprising a base (3) intended to be fixed onto a shoe part, a tensioning lever (2) with two arms hinged on this base by the ends of its arms, a first hooking member (1) intended to be hooked onto a second hooking member (5) fixed to another part of the shoe, connecting means with an adjustable length between the first hooking means (12) provided with a rod (13) having a threaded part by means of which the rod (13) is integral with a tensioning lever attachment element (14), wherein the attachment element (14) consists of a retaining piece hinged on the tensioning lever (2) by a pin (30) and having a cylindrical longitudinal hole (21) having a smooth inner surface which passes through the attachment element (14) from end to end and through which the said rod (13) passes and of a rotating adjustment button (22) provided with a tapped hole into which the said threaded part of the rod is screwed, this button bearing against the end of the attachment element opposite to the first hooking means, and wherein the assembly formed by the threaded rod (13) and the adjustment button (22) is axially locked inside the attachment element (14) by said pin (30) the surface of said pin creating means for engaging the rod (13) and locking the rod in place within the attachment element (14).

2. A buckle as claimed in claim 1, wherein the threaded part of the rod (13) has a milled portion (29) inside which a part of the circumference of the said pin (30) is engaged so as to lock the rod axially and limit its travel inside the attachment element.

3. A buckle as claimed in claim 2, wherein the rotating button (22) has a constriction (24) by means of which it is engaged inside the attachment element (14), this constriction being provided with an external peripheral groove (27) inside which there is engaged a retaining pin (28) driven into the attachment element.

4. A buckle as claimed in claim 1, wherein the rotating adjustment button (33, 35) has a part (34) bearing against the end of the attachment element (31) and a part engaged inside the attachment element, provided with an external annular groove (36) in contact with the pin (30') hinging the attachment element on the tensioning lever.

* * * * *

UNITED STATES PATENT AND TRADEMARK OFFICE

CERTIFICATE OF CORRECTION

PATENT NO. : 4,893,384

DATED : January 16, 1990

INVENTOR(S) : Vincenzo Bidoia and Orelio Mogno

It is certified that error appears in the above-identified patent and that said Letters Patent is hereby corrected as shown below:

On the title page:

The first inventor's name should be corrected:

"Vancenzo Bidoia" should be --Vincenzo Bidoia--.

Signed and Sealed this

Tenth Day of September, 1991

*Attest:*

HARRY F. MANBECK, JR.

*Attesting Officer*

*Commissioner of Patents and Trademarks*